US009333439B1

(12) United States Patent
Miller

(10) Patent No.: US 9,333,439 B1
(45) Date of Patent: May 10, 2016

(54) FOLDED CONFETTI

(71) Applicant: Wanda Miller, Titusville, FL (US)

(72) Inventor: Wanda Miller, Titusville, FL (US)

( * ) Notice: Subject to any disclaimer, the term of this patent is extended or adjusted under 35 U.S.C. 154(b) by 700 days.

(21) Appl. No.: 13/626,478

(22) Filed: Sep. 25, 2012

(51) Int. Cl.
*A63H 37/00* (2006.01)

(52) U.S. Cl.
CPC ..... *A63H 37/00* (2013.01)

(58) Field of Classification Search
CPC ..... A63H 37/00
See application file for complete search history.

(56) References Cited

U.S. PATENT DOCUMENTS 5,352,148 A 10/1994 Watkins
5,354,227 A 10/1994 Watkins
5,507,680 A 4/1996 Watkins
5,643,042 A 7/1997 Watkins
5,709,584 A 1/1998 Watkins
5,807,159 A 9/1998 Watkins
6,299,502 B1 * 10/2001 Cheng ..... A63H 37/00 446/183
6,692,335 B2 2/2004 Watkins
8,146,538 B2 4/2012 Kling et al.

FOREIGN PATENT DOCUMENTS

EP 1629873 3/2006

* cited by examiner

*Primary Examiner* — Michael C Miggins
(74) *Attorney, Agent, or Firm* — Livingston Loeffler, P.A.; Edward M. Livingston, Esq.; Bryan L. Loeffler, Esq.

(57) ABSTRACT

A polygonal-shaped confetti (2) having at least one folded portion (8). As illustrated herein the polygonal-shaped confetti is rectangular-shaped confetti that is placed in stacks (1) folded on a first end (3) and/or a second end (4). The folded portions slow the descent of the confetti and cause the confetti to turn, spiral and dance in the air. The confetti is created by cutting material, such as paper, tissue, plastic, mylar and so forth into substantially elongated polygonal-shaped pieces and then folding in the middle or on one or both ends over of the stack. The confetti may then be a storage device such as a bag (10), box, tube, rubber bands and so forth that maintains the shape of the confetti until use.

10 Claims, 3 Drawing Sheets

FOLDED CONFETTI

FIELD OF THE INVENTION

This invention relates to confetti used to create visual displays at celebrations and more particularly a plurality of confetti that is folded to slow the descent of the confetti and to create a uniform three-dimensional spiraling motion in the air.

BACKGROUND OF THE INVENTION

Conventional confetti comprises a plurality of pieces of paper, tissue, mylar or metallic material which is usually thrown at parades and other celebrations. Such conventional confetti is normally flat pieces of material that is manually thrown into the air or shot into the air using cannon powered by compressed air. After being placed into the air, the confetti drifts to the ground. The goal of using confetti is to allow the confetti to float in the air as long as possible to enhance and prolong the celebration and to create as stunning a visual effect as possible. However, due to the flat surface of conventional confetti it usually falls randomly to the ground in a single, mostly horizontal motion of a two-dimensional manner, with little or no vertical movement.

Therefore, a need exists for an improved confetti that creates multiple movements and produces predetermined uniform three-dimensional vertical movements in the air, thereby increasing the time of the celebration and enhancing the overall visual effect of the confetti.

The relevant prior art includes the following references:

| Pat. No. | Inventor | Issue/Publication Date |
|---|---|---|
| (U.S. patent References) | | |
| 5,352,148 | Watkins | Oct. 4, 1994 |
| 5,354,227 | Watkins | Oct. 11, 1994 |
| 5,643,042 | Watkins | Jul. 1, 1997 |
| 5,507,680 | Watkins | Apr. 16, 1996 |
| 5,709,584 | Watkins | Jan. 20, 1998 |
| 5,807,159 | Watkins | Sep. 15, 1998 |
| 6,692,335 | Watkins | Feb. 17, 2004 |
| 8,146,538 | Kling et al. | Apr. 3, 2012 |
| (Foreign patent References) | | |
| EP1,629,873 | Mann | Mar. 1, 2006 |

SUMMARY OF THE INVENTION

The primary object of the present invention is to provide a folded confetti that creates a prolonged predetermined uniform three-dimensional vertical spiraling effect when thrown in the air.

The present invention fulfills the above and other objects by providing an elongated polygonal-shaped confetti that is folded in the middle or on one or both ends. The confetti is preferably folded on at least one location to create at least one folded portion in a manner that does not to produce a crease in the confetti. The at least one folded portion slows the descent of the confetti and causes the confetti to turn, spiral and dance in the air in a predetermined motion. Because the folded portions are not creased and the confetti is preferably folded while in a stack, the end of each single piece of confetti is bent at a different angle, thereby causing each piece of confetti to move in a uniform predetermined direction and rate when falling through the air. The confetti is created by cutting material, such as paper, tissue, plastic, mylar and so forth into substantially elongated polygonal-shaped pieces and then folding one or portions over. The confetti may then be stored using a various types of storage devices, such as a bag, box, tube, rubber bands and so forth that maintains the shape of the confetti until use. Although the embodiment described herein illustrates a rectangular-shaped piece of confetti, the confetti may be any elongated polygonal-shaped piece of material having at least one folded portion.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
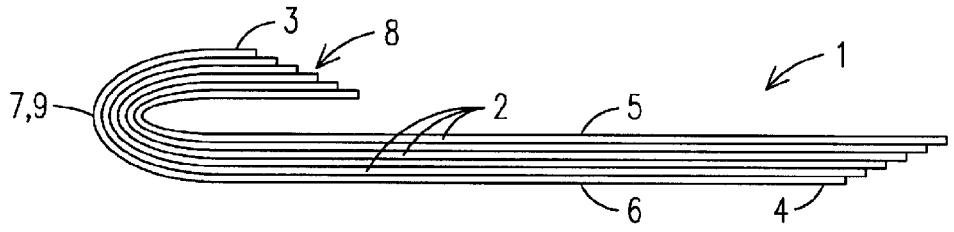
FIG. 1 is a side view of a folded stack of individual pieces of confetti of the present invention.
Figure 2:
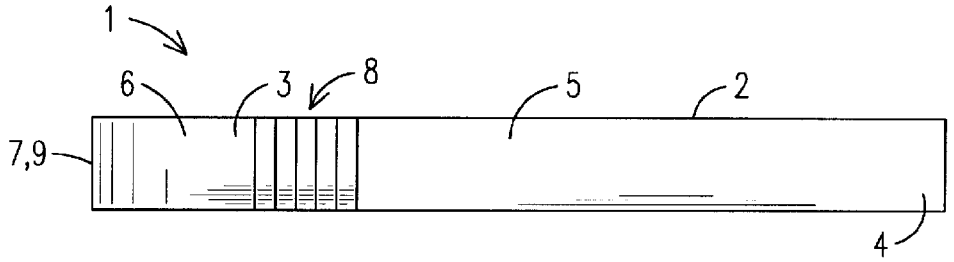
FIG. 2 is a top view of a folded stack of individual pieces of confetti of the present invention.
Figure 3:
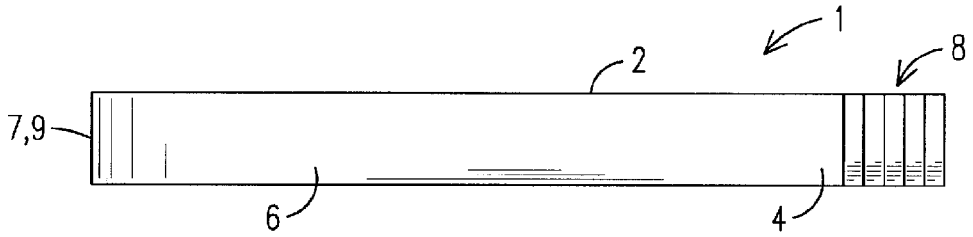
FIG. 3 is bottom view of a folded stack of individual pieces of confetti of the present invention.
Figure 4:
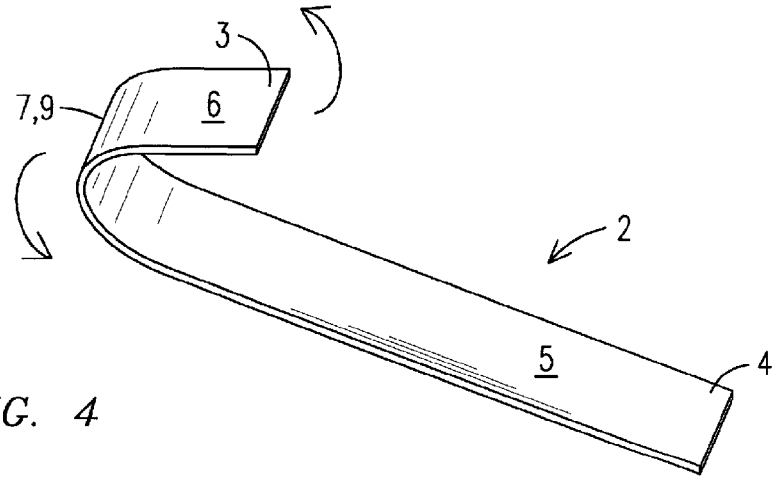
FIG. 4 is a perspective side view of a piece of folded confetti of the present invention.

For purposes of describing the preferred embodiment, the terminology used in reference to the numbered components in the drawings is as follows:

1. stack of confetti
2. confetti
3. first end
4. second end
5. upper surface
6. lower surface
7. fold
8. angled edge
9. folded portion
10. storage means
11. storage bag
12. middle portion With reference to FIGS. 1-3, side, top and bottom views, respectively, of a folded stack 1 of individual pieces of confetti 2 of the present invention are illustrated. Each piece of confetti has a first end 3, a second end 4, an upper surface 5 and a lower surface 6. The confetti 2 is created by cutting stacks of material, such as paper, tissue, plastic, mylar and so forth into substantially rectangular-shaped pieces and then making a fold 7 on the first end 3 of the stack 1, thereby creating a substantially J-shaped stack. The folded confetti 2 may also be created individually and although the confetti 2 illustrated here is rectangular-shaped, the confetti 2 may be any other shape (such as a tetragon, triangle, trapezoid, parallelogram, heptagon, octagon and so forth) or polygonal-shaped piece of material having at least one folded portion 9. As illustrated here, the second end 4 of the stack of confetti is left straight. The fold 7 creates a plurality of varying lengths on the first end 3 as demonstrated by angle edges 8 located on the first end 3 and the second end 4. The first end is preferably only folded over and not creased, thereby allowing each folded portion 9 to spring away from the upper surface 5 of the confetti, as illustrated in FIG. 4. The folded portion 9 catches the air and causes the confetti 2 to spin, thereby creating a three-dimensional to the confetti 2 as it falls through the air in a strait vertical line, while the unfolded portion bends slightly and creates a vortex, thereby decreasing the descent of the confetti 2.

Figure 5:
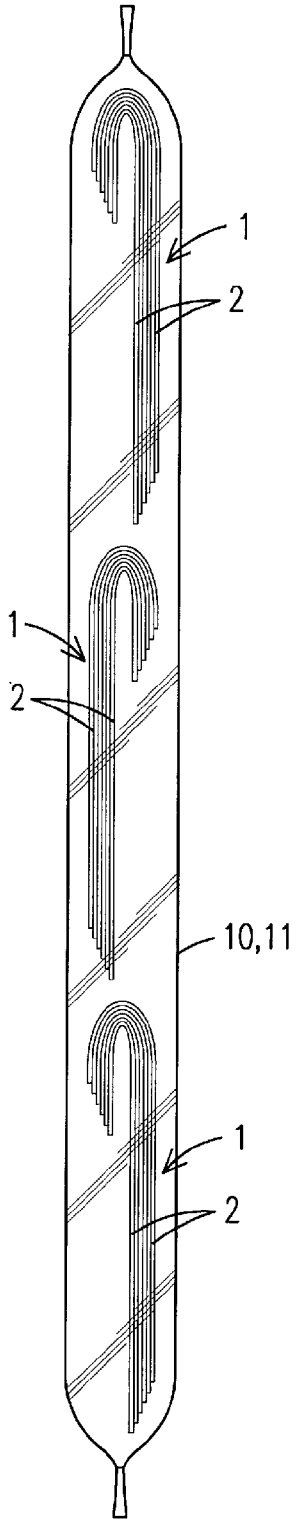
FIG. 5 is a side view of a plurality of stacks of folded confetti of the present invention located in a storage means.
Figure 6:
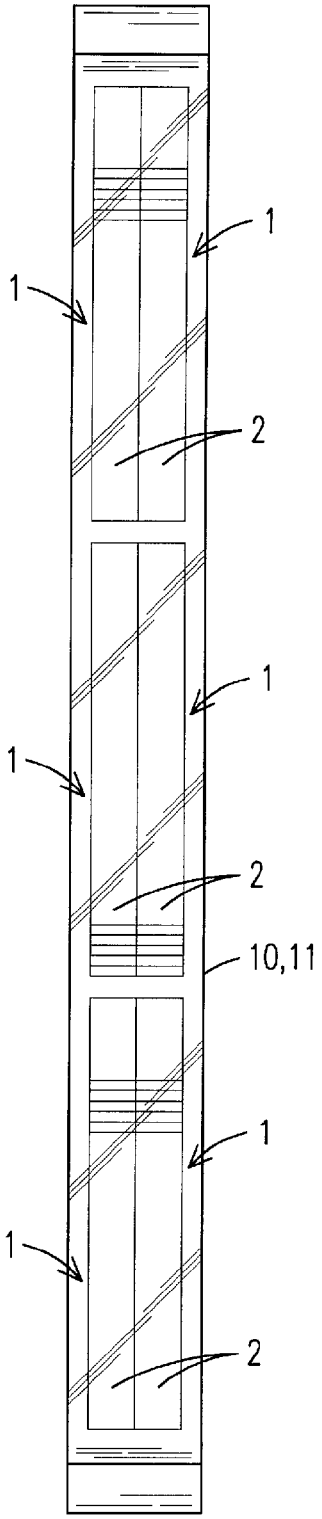
FIG. 6 is a top view of a plurality of stacks of folded confetti of the present invention located in a storage means.
Figure 7:
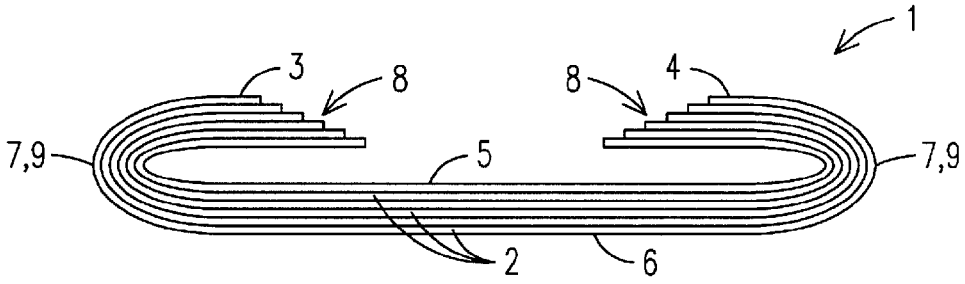
FIG. 7 is a side view of a stack of folded confetti of the present invention wherein a first end and second end are folded in an upward position toward an upper surface of the confetti.

With reference to FIGS. 5 and 6, side and top views, respectively, of a plurality of stacks 1 of folded confetti 2 of the present invention located in a storage means 10 are illustrated. After one or more stacks 1 of confetti 2 are created and folded, the stacks 1 of confetti 2 may then be placed in a storage means 10 that maintains the shape of the folded confetti 2, such as a plastic storage bag 11, a tube, one or more elastomeric bands and so forth. With reference to FIG. 7, a side view of a stack 1 of folded confetti 2 of the present invention wherein a first end 3 and second end 4 are folded in a same direction toward an upper surface 5 of the confetti 2 is illustrated. Such shaped confetti alternates between a horizontal three-dimensional spinning motion, sometimes appearing to stop in mid air while changing direction to a vertical tornado-like motion. As the resulting top fold 7 creates a vortex, it provides extra lift which slows the descent of the spinning confetti.

Figure 8:
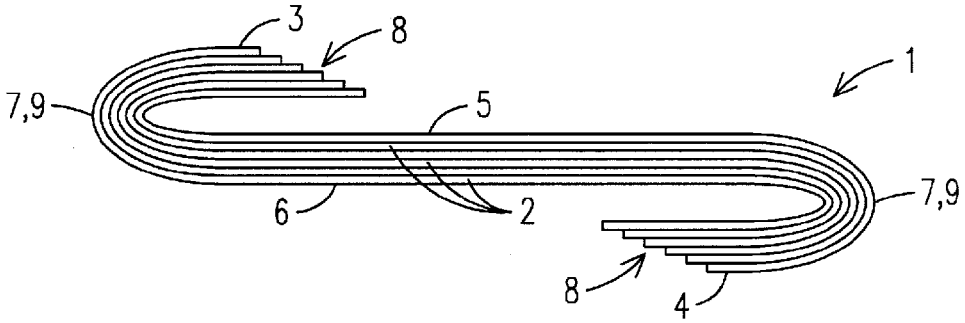
FIG. 8 is a side view of a stack of folded confetti of the present invention wherein a first end is folded in an upward position toward an upper surface of the confetti and second end is folded in a downward position towards a lower surface of the confetti.

With reference to FIG. 8, a side view of a stack 1 of folded confetti 2 of the present invention wherein the ends are folded in opposite directions, specifically a first end 3 is folded in an upward position toward an upper surface 5 of the confetti 2 and second end 4 is folded in a downward position towards a lower surface 6 of the confetti is illustrated. The somewhat Z-shaped confetti results in a three-dimensional vertical motion very similar to that of confetti 2, but with a slight side-to-side rocking motion and slower spin and fall rate.

Figure 9:
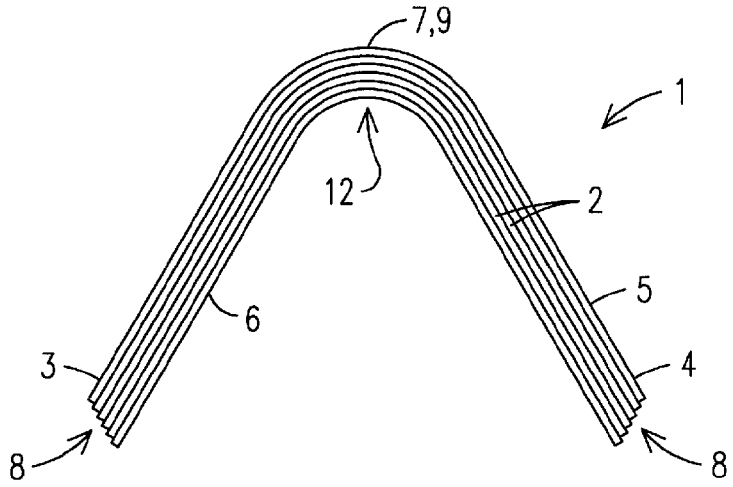
FIG. 9 is a side view of a stack of folded confetti of the present invention wherein a fold is located in the center of the confetti.

Finally with reference to FIG. 9, a side view of a stack of folded confetti 1 of the present invention wherein a fold 7 is located along a middle portion 12 of the confetti is illustrated. The somewhat V-shaped or U-shaped confetti results in twirling three-dimensional appearance as it falls through the air.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A folded confetti comprising:

a plurality of polygonal-shaped pieces of material arranged in a stack wherein each of the polygonal-shaped pieces of materiel are evenly aligned on top of each other in the stack;

said plurality of similar polygonal-shaped pieces of material each having an upper surface, a lower surface, at least one perimeter edge and at least one fold creating a folded portion; and said at least one folded portion on each of the plurality of similar polygonal-shaped pieces of material is created by folding the entire stack in unison so that each of the folds located on the plurality of similar polygonal-shaped pieces of material are aligned with each other in the stack.

2. The folded confetti of claim 1 wherein:

the at least one folded portion further comprises a fold located on a first end folded toward the upper surface of each of the polygonal-shaped pieces of material and a fold located on a second end of each of the polygonal-shaped pieces of material folded toward the upper surface of each of the polygonal-shaped pieces of material.

3. The folded confetti of claim 1 wherein:

the at least one folded portion further comprises a fold located on a first end folded toward the upper surface of each of the polygonal-shaped pieces of material and a fold located on a second end of each of the polygonal-shaped pieces of material folded toward the lower surface of each of the polygonal-shaped pieces of material.

4. The folded confetti of claim 1 wherein:

said folded confetti is stored in a storage means.

5. A folded confetti comprising:

at least two strips of substantially rectangular-shaped material each having a first end, a second end, an upper surface and a lower surface;

said at least two strips of substantially rectangular-shaped material being arranged in a stack wherein a perimeter edge of each of the at least two strips of substantially rectangular-shaped material are substantially even;

a fold located on the first ends of each of the at least two strips of substantially rectangular-shaped material; and each fold is created by folding the entire stack in unison so that each of the folds located on the at least two strips of substantially rectangular-shaped material are aligned with each other in the stack.

6. The folded confetti of claim 5 further comprising:

a fold located on the second ends of each of the at least two strips of substantially rectangular-shaped material.

7. The folded confetti of claim 5 wherein:

said folds located on the first ends of each of the at least two strips of substantially rectangular-shaped material are toward the upper surfaces of the least two strips of substantially rectangular-shaped material; and said folds located on the second ends of each of the at least two strips of substantially rectangular-shaped material are toward the upper surfaces of the at least two strips of substantially rectangular-shaped material.

8. The folded confetti of claim 5 wherein:

said folds located on the first ends of each of the at least two strips of substantially rectangular-shaped material are toward the upper surfaces of the least two strips of substantially rectangular-shaped material; and said folds located on the second ends of each of the at least two strips of substantially rectangular-shaped material are toward the lower surfaces of the at least two strips of substantially rectangular-shaped material.

9. The folded confetti of claim 5 wherein:

said folded confetti is stored in a storage means.

10. A folded confetti comprising:

a plurality of similar polygonal-shaped pieces of material arranged in a stack wherein each of the polygonal-shaped pieces of materiel are evenly aligned on top of each other in the stack;

said plurality of similar polygonal-shaped pieces of material each having an upper surface, a lower surface, at least one perimeter edge and at least one fold creating a folded portion; and said at least one folded portion on each of the plurality of similar polygonal-shaped pieces of material is created by creating a single fold through the entire stack in unison.

* * * * *